United States Patent [19]

Burysek et al.

[11] Patent Number: 4,885,906

[45] Date of Patent: Dec. 12, 1989

[54] DEVICE FOR AUTOMATICALLY SPINNING-IN YARN

[75] Inventors: František Buryšek, Ûstí bad Orlicí ; Pavel Andrlík, Liberec, both of Czechoslovakia

[73] Assignee: Vyzkumny ustav bavlnarsky, Ûstí nad Orlicí , Czechoslovakia

[21] Appl. No.: 249,486

[22] Filed: Sep. 23, 1988

[30] Foreign Application Priority Data

Sep. 23, 1987 [CS] Czechoslovakia ..... PV 6812-87

[51] Int. Cl.[4] ..... D01H 15/02; D01H 13/04

[52] U.S. Cl. ..... 57/263; 57/279; 57/352

[58] Field of Search ..... 57/261-263, 57/279, 280, 352

[56] References Cited

U.S. PATENT DOCUMENTS

| | | | |
|---|---|---|---|
| 3,605,396 | 9/1971 | Guignard et al. | 57/263 X |
| 3,695,017 | 10/1972 | Hori et al. | 57/263 |
| 3,810,352 | 5/1974 | Miyazaki et al. | 57/263 |
| 3,826,073 | 7/1974 | Hoeber et al. | 57/263 X |
| 3,942,311 | 3/1976 | Stahlecker | 57/263 |
| 3,962,855 | 6/1976 | Stahlecker | 57/263 |
| 4,041,684 | 8/1977 | Kamp | 57/263 |
| 4,084,398 | 4/1978 | Stahlecker et al. | 57/263 |
| 4,173,114 | 11/1979 | Stahlecker | 57/263 |
| 4,672,802 | 6/1987 | Raasch | 57/263 |

*Primary Examiner*—John Petrakes
*Attorney, Agent, or Firm*—Klein & Vibber

[57] ABSTRACT

A device for automatically spinning-in yarn in spinning units of open-end rotor spinning machines improves the process of leading the spinning-in head of the device onto the take-off tube of the spinning unit by using simple means.

According to the invention the spinning-in head is attached to a swing lever by attaching means kinematically firmly in the plane of its swing motion but resiliently in the direction perpendicular to said plane, in order to allow the spinning-in head to move across the mouth of said take-off tube while being lead by a lead-on cone.

4 Claims, 2 Drawing Sheets

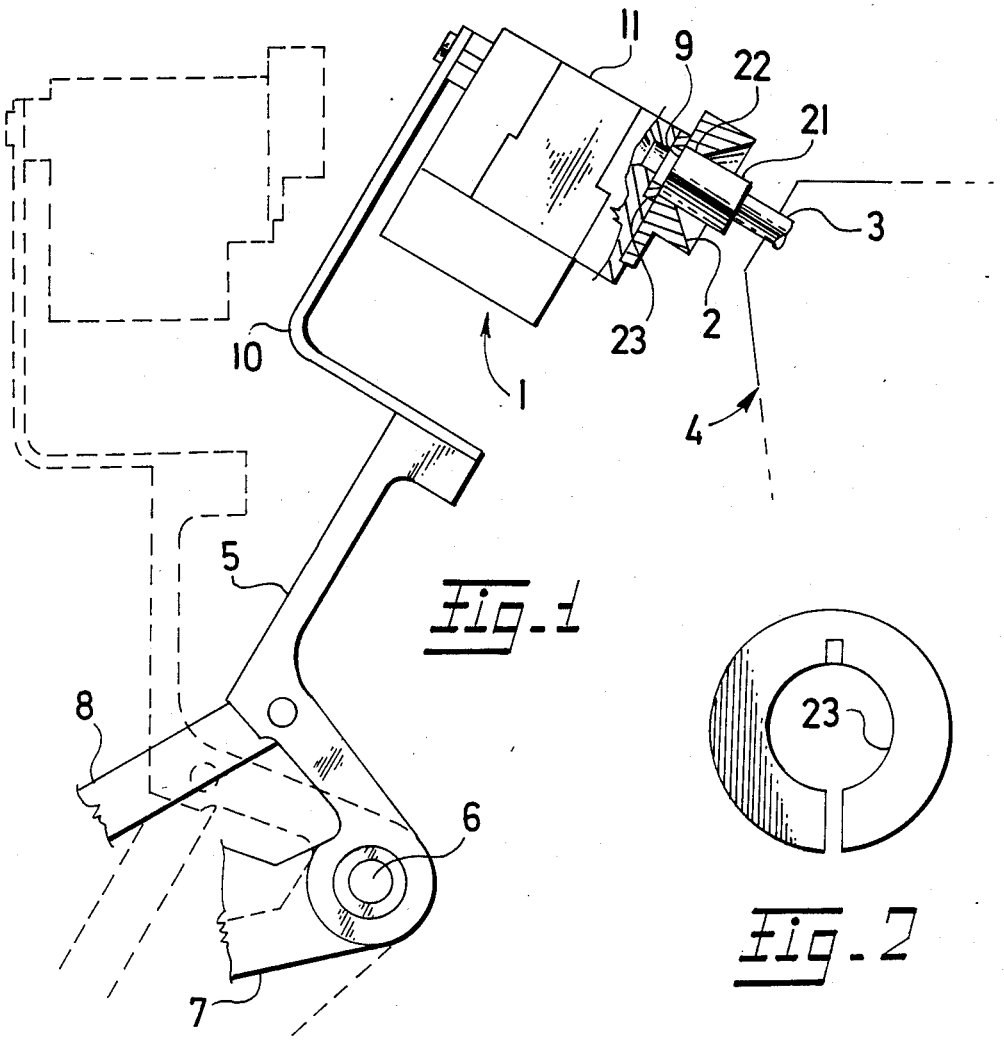
Fig. 1
Fig. 2
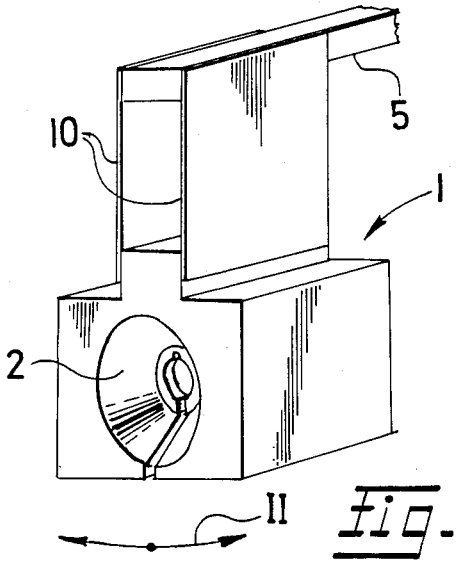
Fig. 3
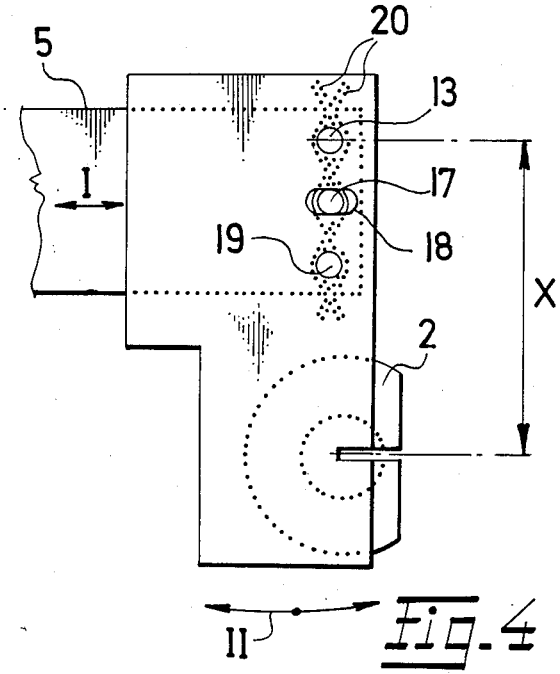
Fig. 4

DEVICE FOR AUTOMATICALLY SPINNING-IN YARN

FIELD OF THE INVENTION

The invention relates to a device for automatically spinning-in yarn into take-off tubes of spinning units of especially open-end rotor spinning machines, the device being adapted for travelling along the machine and comprising, on the one hand, a spinning-in head having a spinning-in conduit and a lead-on cone for leading it onto said take-off tube, said head being attached to a swing lever, and, on the other hand, gearing means coupled with said swing lever.

BACKGROUND OF THE INVENTION

Known open-end rotor spinning machines are composed of a plurality of side-by-side arranged spinning units along which such a device is adapted to travel and to remedy thread breakages by effecting new yarn spinning-in. For the reliable operation of this device it is inevitable that it must be capable of perfectly introducing the yarn to be spun-in into the take-off tube.

In view of some inaccuracies in the machine manufacture, which are not economically avoidable, and of problems of precisely arresting the travelling unit opposite the work station, the precise location of the yarn introducting device onto the mouth of take-off tube is very troublesome. According to the German Published Patent Application (DE-OS) No. 2,361,787, this problem has been solved by the take-off or spinning-in tube being mounted in the spinning unit resiliently and centered by being engaged by said yarn end introducing device.

A disadvantage of this known device is that such a resiliently arranged take-off tube has to be provided at each of the spinning units and, since the tube is movable in necessary gaps to enable this motion, these gaps get choked with fibrous dust which may cause a tube malfunction, or even make the correct introduction of yarn up into the spinning rotor impossible.

Another device for automatic introduction of yarn into the outlet tube of spinning unit has been described in the German Published Patent Application (DE-OS) No. 2,711,163, wherein the precise positioning and fixation thereof relative to the spinning unit is effected e.g., by a spherical head disposed on the spinning unit, in cooperation with a corresponding wedge-like guide on the travelling unit, or by a conical pin on the spinning unit, and a ring-formed element on a defining rod of the travelling unit. Such a positioning device is designed for defining the position of the entire travelling unit relative to each of the spinning units. This German application also discloses another embodiment of the device for precisely introducing yarn into the outlet tube of the spinning unit wherein the spinning-in head is provided with a holder carrying a centering guide. After the spinning-in head has been brought, together with the guide, to the spinning unit, the centering guide will engage a centering surface provided in the spinning unit. In this way, the spinning-in head together with the yarn end is caused to assume the position above the outlet tube. The centering hole surface has a conical inlet so as to compensate for some inaccuracies while positioning the spinning-in head together with the centering guide.

A drawback of the above-described device is that such a positioning requires the entire mass of the spinning-in unit to be displaced whereby the positioning means get worn within a relatively short time. Another shortcoming is that it is necessary to sporadically adjust the positioning means in order to attain the exact reproduction of the spinning-in unit position above the outlet tube. For this reason, the centering hole surfaces are provided in a bar which is adjustably arranged on the spinning unit. In general, the device is relatively complicated and, apart from this, the bar may get unlocked due to machine vibrations whereby the precise location of the spinning-in head above the outlet tube is impaired.

A further disadvantage of the known device results from the swing motion of the lever supporting the spinning-in head. Even though the spinning-in head is resiliently mountd for a versatile motion relative to the take-off tube of the spinning unit, it cannot be avoided that, if the head is positioned askew at the end of said tube, gaps arise between the head and the tube and, apart from this, the yarn introducing element may get jammed at the end of the tube so that a difficult removal thereof may even cause malfunctions of the automatic travelling service unit.

SUMMARY OF THE INVENTION

It is an object of the invention to eliminate the drawbacks of the prior art as hereinabove set forth and to provide an improved automatic yarn spinning-in device, wherein the spinning-in head together with the spinning-in duct and the yarn end are always exactly guided into the position above the outlet tube of the spinning unit, irrespective of wear arising during the machine operaton, by using relatively simple means therefor.

To meet this object there is provided a device for automatically spinning-in yarn into take-off tubes of spinning units of especially open-end rotor spinning machines, the device being adapted for travelling along the machine and comprising, on the one hand, a spinning-in head having a spinning-in conduit and a lead-on cone for leading it onto said take-off tube, said head being attached to a swing lever, and, on the other hand, gearing means coupled with said swing lever.

According to the invention, the spinning-in head is attached to the swing lever by attaching means kinematically firmly in the plane of its swing motion but resiliently in the direction perpendicular to said plane, in order to allow the spinning-in head to move across the mouth of said take-off tube while being led by said lead-on cone.

The fact that the spinning-in head is led in the swing direction kinematically firmly, but resiliently in the transverse direction to the outlet tube of the spinning unit, is a very advantageous feature of the invention, since the head does not become too sensitive to the precise location of the service unit relative to the spinning unit, and to some inaccuracies given by the manufacture of the latter. Apart from this, the lead-on cone and its cylindrical extension do not get jammed when being put on and off the spinning-in tubes. In the work position, the gap between the mouth of the take-off tube and the spinning-in head is perfectly sealed so that, due the absence of any vacuum loss in said gap, the yarn is reliably introduced up into the spinning rotor.

In a preferred embodiment of the invention, the lead-on cone is precisely guided by simple means, and particularly by two flat springs arranged parallel to each other in the yarn introducing position across the mouth of the take-off tube.

According to another embodiment, the guiding is effected by means of a pivot oriented, in the yarn introducing position, in parallel to the axis of take-off tube mouth while the yarn introducing element is mounted for swinging about this pivot and is held in this position by an elastic member.

In another embodiment which exhibits the same effect, the pivot is replaced by a sliding box whose axis extends across the axis of the take-off tube mouth while the yarn introducing element is held in its active position by the elastic member. The latter consists preferably of a pair of springs bearing on a pin disposed outside the guideway. Alternatively, a so-called silent-block can serve as the elastic member which is an embodiment preferred from the viewpoint of manufacture.

With all of the above-described embodiments, the surface of the yarn introducing element coming in contact with the take-off mouth can be provided with an elastic packing which, in the plane of element motion, has a slit of a width corresponding at least to the yarn diameter. This measure is to improve the sealing of the element relative to the take-off tube. Alternatively, the take-off tube mouth can be provided with such packing with which, however, the slit is omitted.

BRIEF DESCRIPTION OF THE DRAWING

With these and other objects in view, which will become apparent in the following detailed description, the present invention, which is shown by example only, will be clearly understood in connection with the accompanying drawing, in which:

FIG. 1 shows a side view of the spinning-in head on the swing lever in work position, i.e., after being drawn over the take-off tube of the spinning unit;

FIG. 2 is a top view of the elastic packing;

FIG. 3 is a perspective view of the spinning-in head secured by means of leaf springs;

FIG. 4 is a top view of the spinning-in head attached by means of three pivots and two adjacent springs;

DESCRIPTION OF THE PREFERRED EMBODIMENTS

Figure 5:
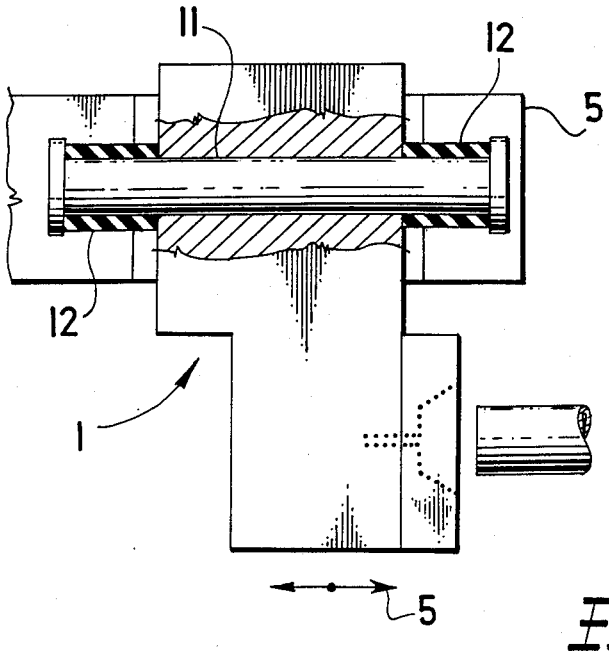
FIG. 5 shows another embodiment having a pivot and an elastic member.

The automatic spinning-in device is shown in FIG. 1 only to the extent only that it immediately relates to the subject of present invention, since various travelling modes thereof are well-known. The device comprises a spinning-in head 1 and a lead-on cone 2 for leading it onto the take-off tube 3 of spinning unit 4. The spinning-in head 1 is attached to a swing lever 5 which is mounted on a pivot 6 in the frame 7 of travelling device and coupled with gearing means 8 such as a tie rod of a pneumatic power cylinder, a solenoid, a mechanical drive or the like.

Referring to FIGS. 1 and 2, the take-off tube 3 is provided at its end with an extension 21, preferably in the form of a cylinder which is coaxial with the take-off tube 3. Opposite the extension 21, in the work position of the spinning-in head 1, the lead-on cone 2 is disposed; the cone 2 terminates in a cylindricl guideway 22 to be drawn over the external cylidrical surface of the extension 21. The mouth 9 of the take-off tube 3, or the bottom of the cylindrical guideway 22 of the lead-on cone 2 of the spinning-in head 1, respectively, is provided with a packing 23. In the latter case, the packing has a slit 24.

Referring to the figures generally, the spinning-in head 1 is attached to the swing-lever 5 by attaching means 10, 11, 13, 17, 19 and 20, and particularly kinematically firmly in the plane of its motion direction (I, FIG. 4) but resiliently or elastically in the direction perpendicular to said motion plane (II, FIGS. 3–4). Thus, the spinning-in head 1, when being led by said lead-on cone 2 onto the take-off tube 3, is allowed to swing across the mouth 9 of said tube 3.

The kinematically firm attachment of the spinning-in head 1 in the plane of motion of the swing lever 5 is advantageous in that the axis of the yarn introducing element is permanently kept parallel to the axis of take-off tube 3.

According to one of the exemplary embodiments, as shown in FIG. 3, the attaching means is at least one leaf spring 10 whose surface, in the spinning-in position of the spinning-in head 1, is parallel to the axis of take-off tube 3. It, however, is more preferable to use of pair of such springs 10 as shown in FIG. 3.

According to another embodiment (FIG. 5) the attaching means is a compensating pivot 11 which is attached to the swing lever 5 with elastic members 12. The compensating pivot 11 is mounted for free reciprocation through the spinning-in head 1 so as to be, in the yarn introducing position, parallel to the take-off tube 3, and to allows motion in the direction of arrows.

Figure 6:
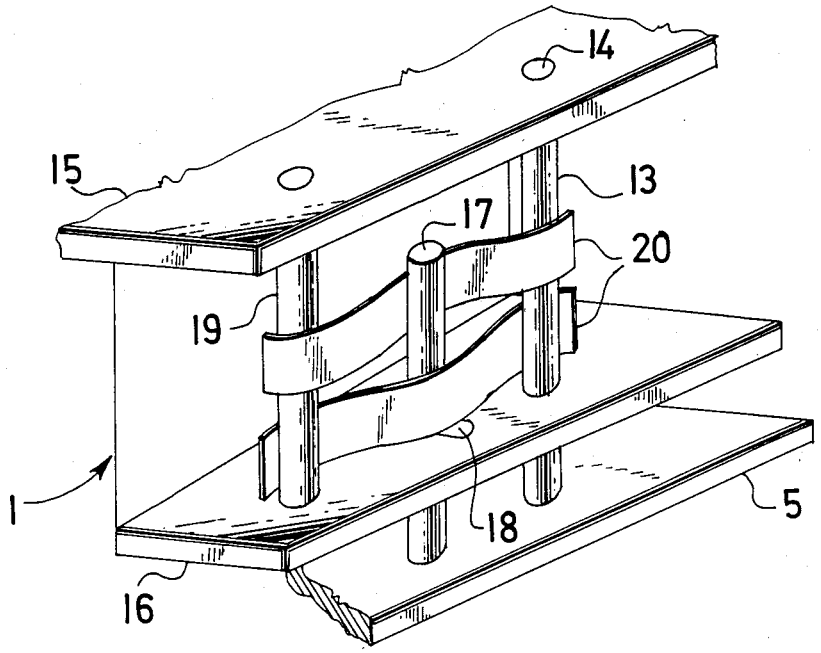
FIG. 6 is a perspective view of the spinning -in head showing the attaching means and the swing lever.

According to the embodiment shown in FIGS. 4 and 6, the preferable kinematically firm guiding of the spinning-in head 1 in the plane of its movement but with a swing motion across the mouth 9 of the take-of tube 3, is achieved by attaching means consisting, on the one hand, of a fixed pivot 13 provided on the swing lever 5 and allowed to pass freely through holes 14 in in two spaced apart guide walls 15 and 16 of the spinning-in head 1, and, on the other hand, of a centering pivot 17 fixedly attached to the swing lever 5 and passing freely through an oval hole 18 in the guide wall 16. Moreover, a thrust pivot 19 is provided in said guide walls 15 and 16. From the side of the fixed pivot 13 and that of the thrust pivot 19, two shaped springs 20 bear on each other, said springs being slidedly shifted and extending at the opposite side of the centering pivot 17. In this way there is obtained a group of three of parallel pivots, 13, 17, and 19, which are associated with at least a pair of shaped springs 20.

MANNER OF OPERATION

In operation, i.e., during the spinning-in process, the swing lever 5 together with the spinning-in head 1 is caused to swing by a gearing means 8 from an initial position (see dotted lines in FIG. 1) to the work position in which the spinning-in head 1 is precisely led by the lead-on cone 2 with its cylindrical guideway 22 onto the extension 21 of the take-off tube 3. This is achieved in that the lead-on cone 2 on said head 1 is allowed, due to its resilient arrangement, to swing out in the transverse direction. This swing motion is oriented across the mouth 9 of the take-off tube 3 while the parallelism of axes of the take-off tube 3 and the cylindrical guideway 22 of the spinning-in head 1 is maintained. Thus, during the transverse swing motion of the spinning-in head 1, the axis of the cylindrical guideway 22 of the lead-on cone 2 remains parallel to the axis of the take-off tube 3. After the elastic packing 23 is engaged, a relatively perfect sealing is effected between the mouth 9 of the take-off tube 3 and the spinning-in head 1.

After the spinning-in proccess, the swing lever 5 together with the spinning-in head 1 is tilted out into its inoperative position while during this motion the yarn is disengaged through the slit 24 in the packing 23 and through a gap in the lead-on cone 2. "I" in FIG. 4 indicates the direction of motion (or the plane of this direction) of the swing lever 5. further, in FIGS. 4 and 5 there is indicated a plane "II" of the transverse swing motion toward the mouth of the take-off tube 3. This transverse motion "II" is perpendicular to the swing direction in the plane "i" of the motion of the swing lever 5.

As shown in FIG. 4, the spinning-in head 1, together with the spinning-unit conduit or the lead-on cone 2, should be provided on the swing lever 5 eccentrically relative to the swinging mounting about the fixed pivot 13, for example, by a distance X. The aforementioned limitation is valid also for all of the above described embodiments but is not obligatory.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A device for automatically spinning-in yarn into a take-off tube of a spinning unit of especially an open-end rotor spinning machines, the device being adapted for travelling along the machine and comprising, a spinning-in head having a spinning-in conduit and a lead-on cone for leading said conduit onto said take-off tube, a swing lever, said head being attached to the swing lever, and gearing means coupled with said swing lever for swinging said swing lever toward and away from said take-off tube, the spinning-in head being attached to the swing lever by attaching means kinematically firmly in a first plane of its swing motion but resiliently in a direction perpendicular to said first plane, thereby allowing the spinning-in head to move across a mouth of said take-off tube while being led by said lead-on cone.

2. A device according to claim 1, wherein the attaching means is at least one leaf spring whose surface, when said spinning-in head is engaged with said take-off tube, is parallel to the axis of the take-off tube.

3. A device according to claim 1, wherein the attaching means comprises an elastic member and a compensating pivot, said compensating pivot attached to the swing lever with the elastic member and freely guided by the spinning-in head so as to be, when said spinning-in head is engaged with said take-off tube, parallel to the take-off tube.

4. A device according to claim 1, wherein the attaching means comprises two spaced apart guide walls provided on said spinning-in head;

a plurality of holes provided in said spaced apart guide walls, at least one of said holes being oval;

a fixed pivot provided on the swing lever and adapted for freely passing through said holes in said two spaced apart guide walls of the spinning-in head;

a centering pivot fixedly attached to said swing lever and adapted for freely passing through said oval hole;

a thrust pivot fixed in one of said guide walls of the spinning-in head; and two shaped disposed at opposite sides of said centering pivot each bent in opposite directions around said centering pivot and said fixed pivot.

* * * * *